US007040605B2

(12) United States Patent
Lappen

(10) Patent No.: US 7,040,605 B2
(45) Date of Patent: May 9, 2006

(54) CONFIGURABLE FENCE AND GATE SYSTEMS

(75) Inventor: Alan Rick Lappen, San Martin, CA (US)

(73) Assignee: RMM Industries, Inc., Gilroy, CA (US)

( * ) Notice: Subject to any disclaimer, the term of this patent is extended or adjusted under 35 U.S.C. 154(b) by 0 days.

(21) Appl. No.: 10/463,317

(22) Filed: Jun. 16, 2003

(65) Prior Publication Data

US 2004/0140464 A1 Jul. 22, 2004

Related U.S. Application Data

(63) Continuation-in-part of application No. 10/349,643, filed on Jan. 22, 2003.

(51) Int. Cl.
*E04H 17/16* (2006.01)

(52) U.S. Cl. ..... 256/10; 256/1; 256/24; 256/26; 136/245

(58) Field of Classification Search ..... 256/1, 256/10, 19, 21, 24, 26, 65.03, 65.04, 65.06; 136/245, 246, 291
See application file for complete search history.

(56) References Cited

U.S. PATENT DOCUMENTS

| | | | | |
|---|---|---|---|---|
| 2,608,386 | A * | 8/1952 | Hart | 256/65.06 |
| 3,037,593 | A | 6/1962 | Webster | |
| 4,280,477 | A | 7/1981 | Divine | |
| 4,381,763 | A | 5/1983 | Kahl | |
| 4,932,085 | A | 6/1990 | Saj | |
| 5,098,238 | A | 3/1992 | Batchelor et al. | |
| 5,480,126 | A | 1/1996 | Teasdale | |
| 5,494,261 | A | 2/1996 | Gandara | |
| 5,628,495 | A | 5/1997 | Gandara | |
| 5,772,186 | A | 6/1998 | Parker | |
| 5,820,316 | A | 10/1998 | Krenzer et al. | |
| 5,961,266 | A | 10/1999 | Tseng | |
| 6,725,601 | B1 * | 4/2004 | Chick | 47/83 |
| 2003/0030047 | A1 * | 2/2003 | Ohanesian | 256/24 |
| 2004/0139689 | A1 * | 7/2004 | Sinha et al. | 52/745.15 |
| 2004/0140462 | A1 * | 7/2004 | Rowley et al. | 256/27 |

FOREIGN PATENT DOCUMENTS

GB 2 077 318 * 12/1981

OTHER PUBLICATIONS

Web pages: Electric Fencing, unknown date, pp. 1-2, Stockyard Ranch Supply, Commerce City, CO, US.

(Continued)

*Primary Examiner*—Daniel P. Stodola
*Assistant Examiner*—Michael P. Ferguson
(74) *Attorney, Agent, or Firm*—Robert Moll

(57) ABSTRACT

A configurable fence system has a solar panel on a mounting surface that can tilt in accordance with a closed loop control system. A solar system for a fence includes a support structure mounted along the top length of the fence, a first mounting surface extending from the supporting structure, a first solar panel on the first mounting surface, a second mounting surface extending from the supporting structure, a second solar panel on the second mounting surface, and a pair of adjustable arms for tilting the first and second mounting surfaces with respect to the fence for sunlight exposure. The pair of arms can be also coupled to a motor and a solar detection and feedback control system for motorized adjustment.

3 Claims, 19 Drawing Sheets

OTHER PUBLICATIONS

Web pages: Solar Electric Fence Chargers, unknown date, pp. 1-4, Oasis Montana, Inc., Stevensville, MT, US.

Web pages: Electric Gates, unknown date, pp. 1-5, Pilgrim Fence Co., Huntington Park, CA, US.

* cited by examiner

CONFIGURABLE FENCE AND GATE SYSTEMS

The present invention relates to configurable fence and gate systems. This application is a continuation-in-part of U.S. application Ser. No. 10/349,643, filed on Jan. 22, 2003, which is incorporated herein by reference.

BACKGROUND

Man has employed many types of fences having different characteristics to indicate property lines, ensure privacy, segregate activities, and provide barriers for property, people and animals. For example, fences made of stones, bricks, and concrete have long service life, but are difficult to alter after construction. Wood fences have low initial cost, are flexible to alter, but have shorter life when exposed to severe climate or pest infestation. Metal fences having insertable panels are durable, pest resistant and have good service life, but have other problems. For example, the manufacturing tolerances necessary to assemble the metal fences make them vulnerable to vibration and noise generation in wind. One metal fence has lateral stiffeners to hold corrugated sheet metal panels, but the stiffener is a fixed width which limits its application to one width of corrugated sheet metal panel. Another metal fence uses a molded polyvinyl chloride (PVC) interlocking sleeve to hold the fence panels. The interlock sleeve is a fixed width, however, which again restricts flexibility in panels that can be used. In addition, sun exposure degrades the molded PVC interlocking sleeve over time destroying the integrity of the fence.

Fences also fail to address certain problems. For example property boundaries are often polygons, that is, closed figures made up of line segments. Two adjacent line segments often form a non-perpendicular angle. Thus, fence sections join at non-perpendicular angles yet need freedom to adjust the angle during construction while maintaining connection strength. Separately, gate widths are often oversized to make sure the gate fits, then a lip or shim added to the gate to cover the gap. This lip/shim technique is labor intensive and affects the appearance of the gate. Another problem concerns the attachment of the gate to the fence post. Gates are cantilever structures which stress the gate hinges. The wider or heavier the gate, the more load the hinge must support. The load can fatigue or deform the hinge causing the gate to sag, the hinge hardware to loosen, and even cause damage to the gate frame or gate post. In some cases, if this damages the gate frame or gate post too much, the gate hinges will need to be relocated.

SUMMARY OF THE INVENTION

The present invention relates to a fence and gate system. In an embodiment, the system includes a pair of fence posts connected by two fence stringers forming a fence framework. The system also includes a pair of L-shaped retainer angles, which are parallel to each other, attached adjacent the fence framework, and define the thickness of the panel to be inserted. The retainer angles are mounted on the surface of the framework either face-to-face or back-to-back forming a slotted frame. At least one fence panel is inserted into the slotted frame. Thus, the invention describes a fence and gate system capable of accommodating a variety of panel styles, materials and thicknesses.

In other features, the system provides for an insert sandwiched between the panels, an adjustable post angle adapter for joining fence sections, a gate width opening adjuster, and a threaded insert bolt structure that distributes stress in a gate hinge and gate post, but is not strictly limited, to the fence and gate system.

In various embodiments, the fence and gate system is moderate in cost, easy to install, reconfigure, maintain and repair, and is strong, durable, able to withstand severe climate conditions, pest resistant, and attractive in appearance. In an embodiment, the fence and gate system is made of preformed and pre-coated galvanized steel sheet metal panels, steel structures and extrusions tubing which is readily available, strong, rigid, corrosion resistant, durable, flexible in style, easy to install and reconfigure, and have long service life. In another embodiment, the fence system can support or contain solar panel(s) either for the generation of electrical power or for generating thermal energy.

DETAILED DESCRIPTION OF THE PREFERRED EMBODIMENTS

Figure 1:
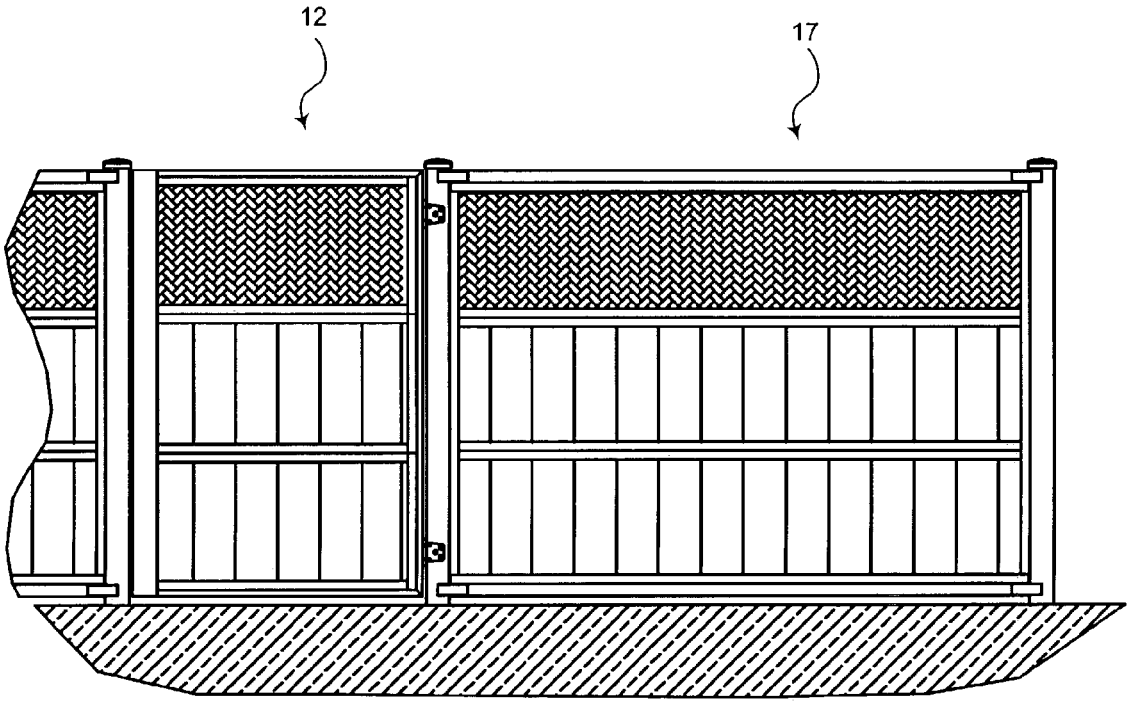
FIG. 1 illustrates an embodiment of the fence and gate system.

The following description includes the best mode of carrying out the invention. The detailed description is made for the purpose of illustrating the general principles of the invention and should not be taken in a limiting sense. The scope of the invention is best determined by reference to the claims. Each part, even if structurally identical to other parts, is assigned its own part number to help distinguish where the part appears in the drawings.

FIG. 1 illustrates the fence and gate system. As shown in FIG. 1, the fence and gate system includes at least one fence section 17 connected to at least one gate assembly 12. The embodiment can be configured to different fence framework styles as well as gate styles to fulfill the requirements and needs according to the user's imagination. This flexibility in configuration will be illustrated with examples as other embodiments of the present invention later.

Figure 2A:
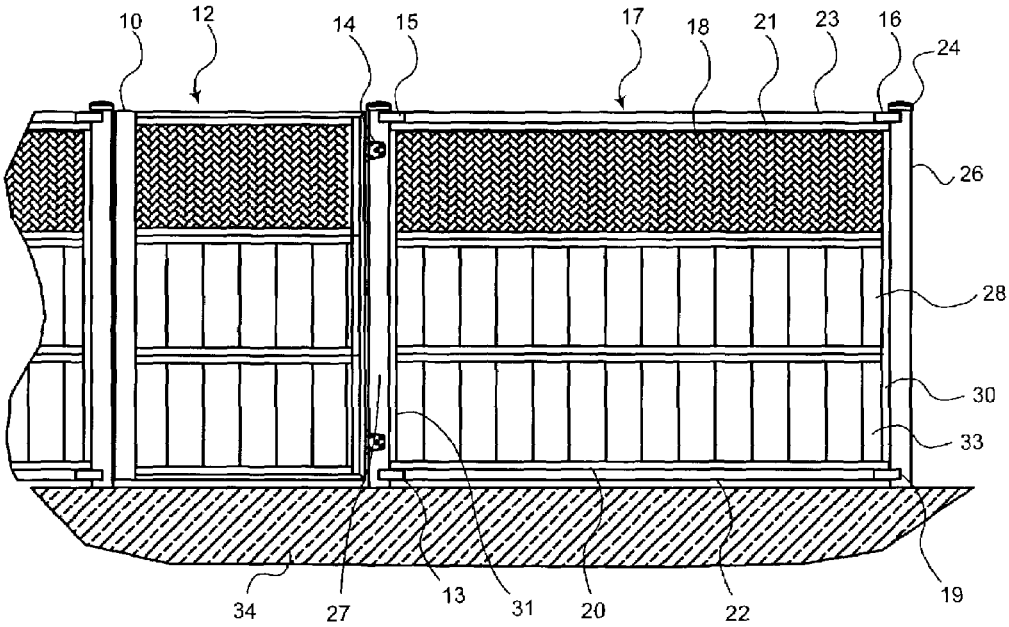
FIG. 2A illustrates an embodiment of the finished fence and gate system.
Figure 2B:
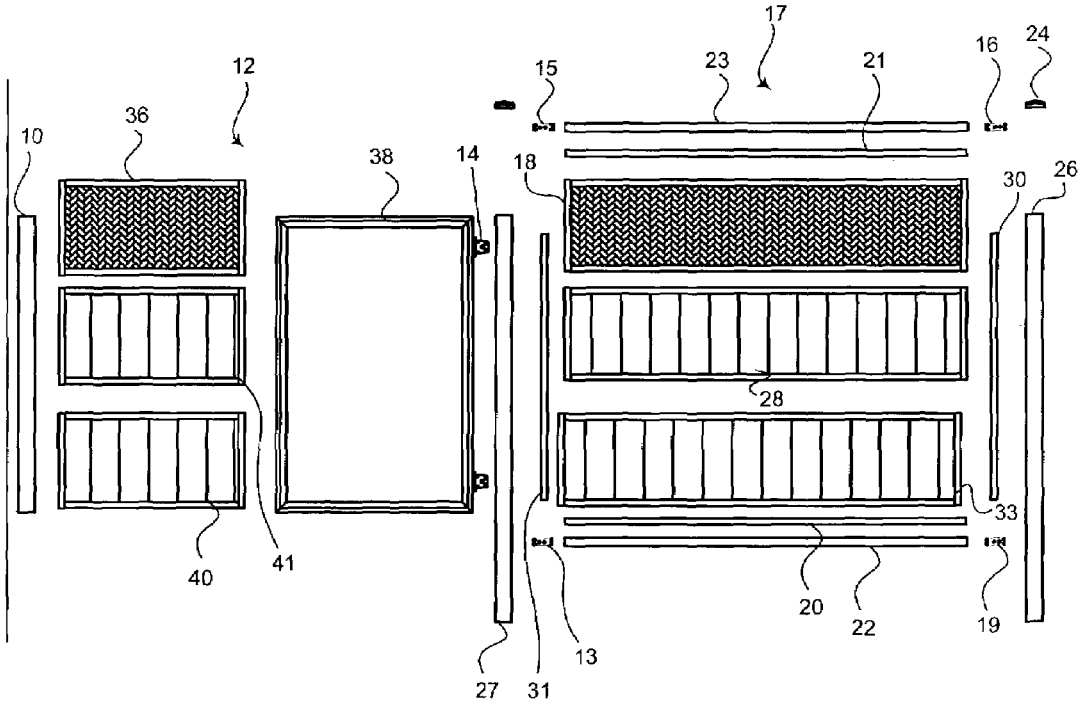
FIG. 2B is an exploded view of fence and gate system shown in FIG. 2A.

FIG. 2A shows the finished fence and gate system in an embodiment including the parts that comprises it. FIG. 2B is an exploded view of the assembled fence and gate system shown in FIG. 2A. FIGS. 2A–2B shows the parts of the fence and gate system. Each fence section 17 includes two fence posts 26, 27, which in one embodiment are constructed of industry standard thickness precoated galvanized steel tubing of predetermined length. Each end of the fence section 17 is anchored to the foundation or soil 34 by fence posts 26, 27. Placed on top of each fence posts 26, 27 is a post cap, such as post cap 24 on fence post 26. It can be a variety of styles such as an ornamental post cap to keep out rain or ornamental lamp (not shown). A fence stringer 22, which in one embodiment is constructed of industry standard thickness galvanized steel tubing of predetermined length, is placed at the bottom with specified clearance from the soil, and connects the two fence posts 26, 27. Each end of the fence stringer 22 is firmly attached to the fence posts 26, 27 using a pair of stringer hangers 13, 19 and a plurality of self drilling and self tapping screws identical to the screw 42 shown in FIG. 3A.

A pair of cross section L-shaped retainer angles, the front L-shaped retainer angle 20 being shown, which in one embodiment are constructed of industry standard thickness precoated galvanized steel sheet metal extrusion of predetermined length, are fastened parallel and face-to-face to the fence stringer 22 using a plurality of self drilling and self tapping screws such as the screw 42 forming a cross section U-shaped slot along the length of the fence stringer 22.

A pair of cross section L-shaped side retainer angles 30, 31, which in one embodiment are constructed of industry standard thickness precoated galvanized steel sheet metal extrusion of predetermined length, are fastened parallel and face-to-face to the interior side of each fence post 26, 27 using a plurality of self drilling and self tapping screws identical to the screw 42 forming a cross section U-shaped slot along the length of the interior side of the fence posts 26, 27.

A cross section U-shaped three-sided slotted fence framework is thus formed to insert and to hold the fence panels 28, 33 and the lattice fence panel 18 in place. The fence panels 28, 33 are constructed of but not limited to corrugated precoated galvanized steel sheet metal of predetermined length, wood, plastic, fiber glass or composite material, and the lattice fence panel 18 is constructed of but not limited to wood, steel sheet metal or other materials, are inserted into the slotted structure sequentially. The design of the individual panels such lattice or corrugated etc. is not considered to be essential to the present invention and is simply a matter of preference.

A pair of cross section L-shaped retainer angles, the front L-shaped retainer angle 21 being shown, is fastened parallel and face-to-face to a fence stringer 23 using a plurality of self drilling and self tapping screws identical to the screw 42 forming a cross section U-shaped slot along the full length of the fence stringer 23. The lattice fence panel 18 is capped under compression by the slotted top fence stringer assembly. The fence stringer 23 is firmly attached on both ends to the fence posts 26, 27 using a pair of stringer hangers 15, 16 on each side, and a plurality of self drilling and self tapping screws identical to the screw 42. If necessary, additional self drilling and self tapping screws can be used to hold the panels in place.

Figure 3A:
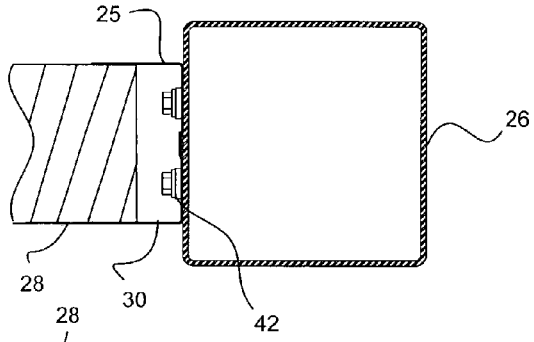
FIG. 3A is a top view of a fence post shown in FIG. 2A showing face-to-face mounting of a pair of L-shaped side retainer angles to the fence post holding the fence panel.
Figure 3B:
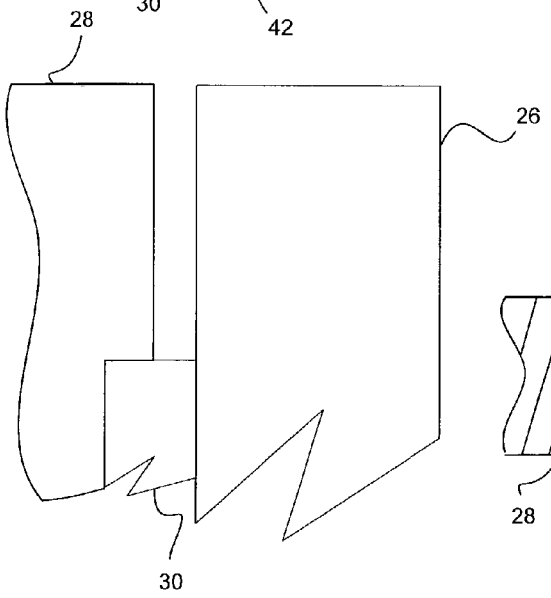
FIG. 3B is a front view of the fence post shown in FIG. 3A.
Figure 3C:
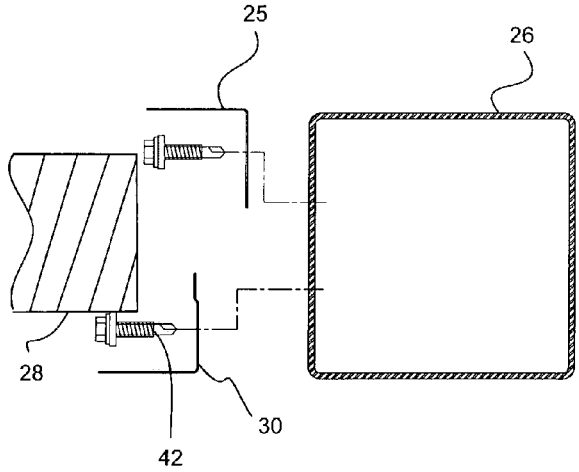
FIG. 3C is an exploded view of the fence post shown in FIG. 3A.
Figure 3D:
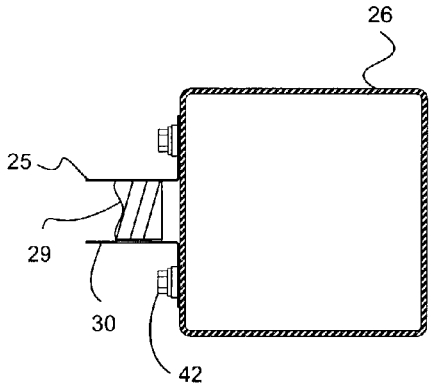
FIG. 3D is a top view of the fence post showing back-to-back mounting of a pair of L-shaped side retainer angles to the fence post holding the fence panel.
Figure 3E:
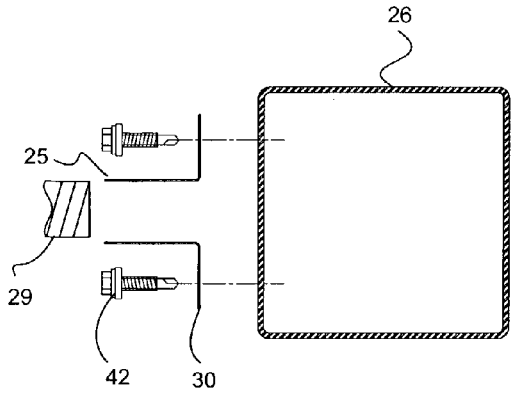
FIG. 3E is an exploded view of the fence post shown in FIG. 3D.

In another embodiment, the L-shaped retainer angles 20, 21 and the L-shaped side retainer angles 30, 31 can be fastened parallel and back-to-back on the fence stringers 22, 23 and fence posts 26, 27 to form a cross section U-shaped three-sided slotted fence framework in similar manner to that shown in FIGS. 3D and 3E.

The gate assembly 12 is in one embodiment constructed of Industry standard thickness galvanized steel tubing and sheet metal strips of predetermined length. The rectangular structure is welded together with a surround back metal flange 82 (FIG. 11B) to form a gate frame 38 with resemblance to a picture frame. A plurality of gate hinges such as gate hinge 14 is welded onto the gate frame 38. The gate panel 40 constructed of material not limiting to corrugated precoated steel sheet metal or wood and the lattice gate panel 36 constructed of not limiting to wood, steel sheet metal or other material, are fastened onto the gate frame 38 using a plurality of self drilling and self tapping screws identical to screw 42 to form the gate assembly 12. The gate assembly 12 is firmly attached to the fence post 27 through a plurality of gate hinges identical to gate hinge 14, using a combination of a plurality of hardware to be described in detail in FIGS. 11A, 11B and 11C. A gate width opening adjuster 10 is attached to the gate frame 38 using a plurality of self drilling and self tapping screws identical to screw 42. Those who are skilled in arts will realize that the panel and lattice material used in the preferred embodiment is not limited to precoated sheet metal, wood, plastic, composite material, fiber glass and therefore is not restrictive in interpretation.

FIG. 3A is a detailed top section view of the fence post in an embodiment. A pair of cross section L-shaped side retainer angles 25, 30, which in one embodiment are constructed of industry standard thickness precoated galvanized steel sheet metal extrusion of predetermined length, are fastened parallel and face-to-face to the interior vertical side of each fence post using a plurality of self drilling and self tapping screws identical to the screw 42 forming a cross section U-shaped slot along the interior side of the fence posts 26. A fence panel 28 of certain thickness that determines the spacing of the cross section L-shaped side retainer angles 25, 30 is held tightly in the cross section U-shaped slot formed.

FIG. 3B is a front view of FIG. 3A showing the fence panel 28 being held in place by a pair of cross section L-shaped side retainer angles, the front angle 30 being shown. FIG. 3C is an exploded assembly view of the fence post shown in FIG. 3A. FIG. 3D is a detailed top section view of the fence post in another embodiment. A pair of cross section L-shaped side retainer angles 25, 30, which in one embodiment are constructed of industry standard thickness precoated galvanized steel sheet metal extrusion of predetermined length, are fastened parallel and back-to-back to the interior vertical side of the fence post 26 using a plurality of self drilling and self tapping screws identical to screw 42 forming a cross section U-shaped slot along the interior side of the fence post 26. A fence panel 29 has a certain thickness that determines the spacing between the cross section L-shaped side retainer angles 25, 30 is held tightly in the cross section U-shaped slot formed. FIG. 3E is an exploded assembly view FIG. 3D showing the parts that comprise the structure.

The U-shaped slot formed in the embodiments shown in FIGS. 3A and 3D has the flexibility to accept fence panels 28, 29 of different thicknesses by adjusting slot width or mounting orientations without the need to change the types of fence parts.

Figure 4A:
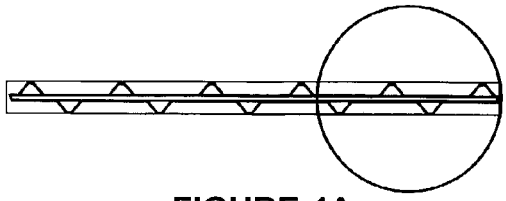
FIG. 4A is a top view showing two fence panels sandwiching a panel insert held in place by a pair of L-shaped side retainer angles.
Figure 4B:
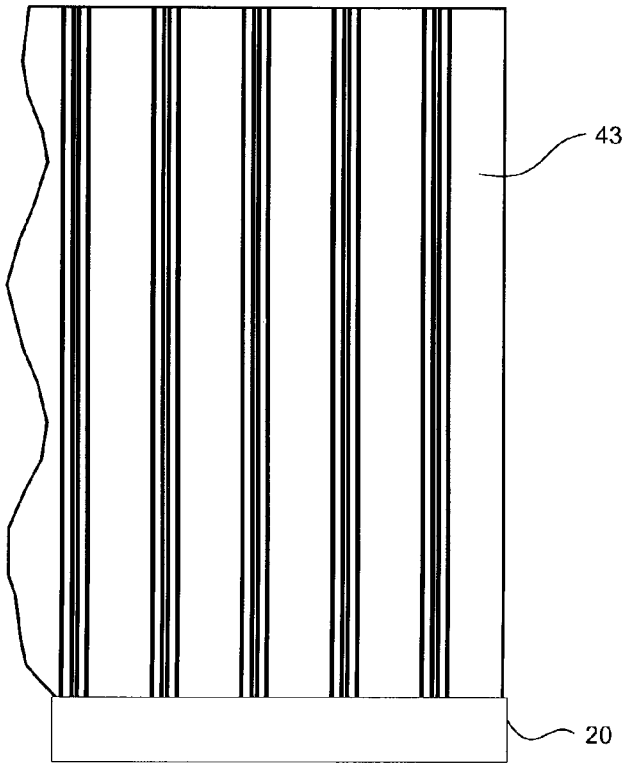
FIG. 4B is a front view of one fence panel shown in FIG. 4A.
Figure 4C:
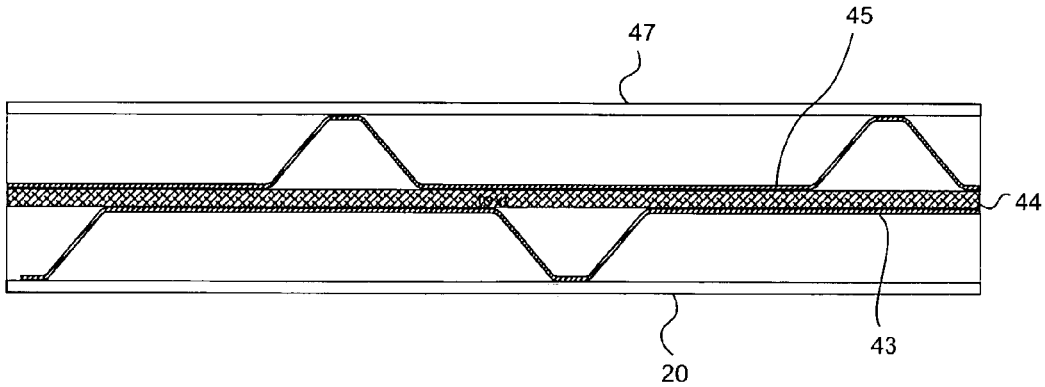
FIG. 4C is an enlarged top view of the fence panels held in place by a pair of L-shaped side retainer angles partially shown in FIG. 4B.

FIG. 4A shows the top view of panel in another embodiment with a panel sandwiching configuration. FIG. 4B is a front view of FIG. 4A with sandwiching panel configuration held in place by a pair of retainer angles 20, 47 (FIG. 4C) on each side. FIG. 4C is a detailed view of FIG. 4A. The panels 43, 45 are held tightly in place by a pair of retainer angles 20, 47. The fence panels 43, 45 are constructed of a wide range of material and are not limited to such as precoated corrugated sheet metal, wood, plastic, fiber glass or any composite material. The panel insert 44 is constructed of a wide range of material and not limited to such as fiber board, plastic, composite or foam. The panel insert 44 functions as spacer to fill slack under compression from the retainer angles 20, 47 on each side. If the panel insert 44 material has acoustic property, it also functions as a noise suppression layer to dampen panel resonance, vibration or echoes under wind load and traffic noise. The extent of sandwiched area may vary from a full fence width to a portion of the fence width.

Figure 5A:
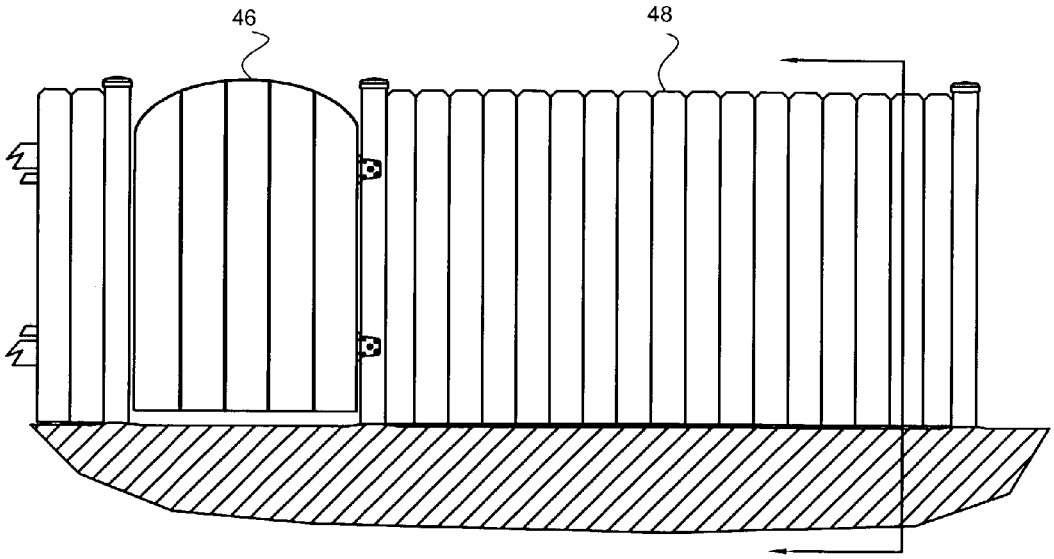
FIG. 5A illustrates a fence and gate system configured to use fence boards.
Figure 5B:
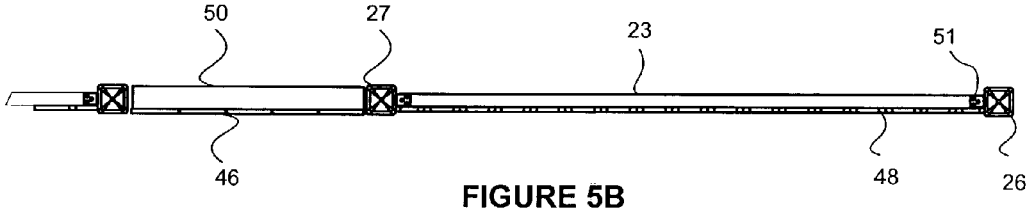
FIG. 5B is a top view of the fence and gate system shown in FIG. 5A.
Figure 5C:
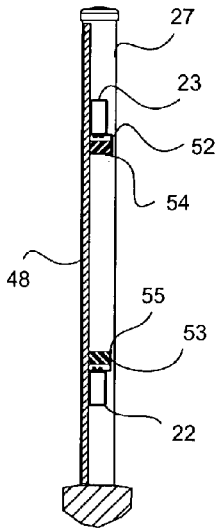
FIG. 5C is a sectional side view of the fence and gate system shown in FIG. 5A.

FIG. 5A illustrates an embodiment using substantially identical parts that can be configured to accept traditional fence boards 48 and gate boards 46. In various embodiments, the parts could be made of wood, metal, or a combination thereof. The parts will be now described as primarily of wood. FIG. 5B shows the top view of the fence and gate shown in FIG. 5A. A plurality of stringer angle hanger identical to the angle hangar 51 and a wood horizontal gate stringer 50 are used in this configuration. FIG. 5C shows the sectional side view of FIG. 5A. The fence stringers 22, 23 are rotated 90 degree from what was described in the earlier embodiment, and mounted on the top and the bottom across the fence posts 26, 27 with a plurality of stringer angle hangers identical to the stringer angle hangar 51. Wood horizontal fence stringers 54, 55 are attached to the fence stringers 22, 23 through a plurality of stringer angle hangers 52, 53 and wood screws. Wood fence boards 48 are attached onto the horizontal fence stringers 54, 55 by a plurality of wood screws.

Figure 6A:
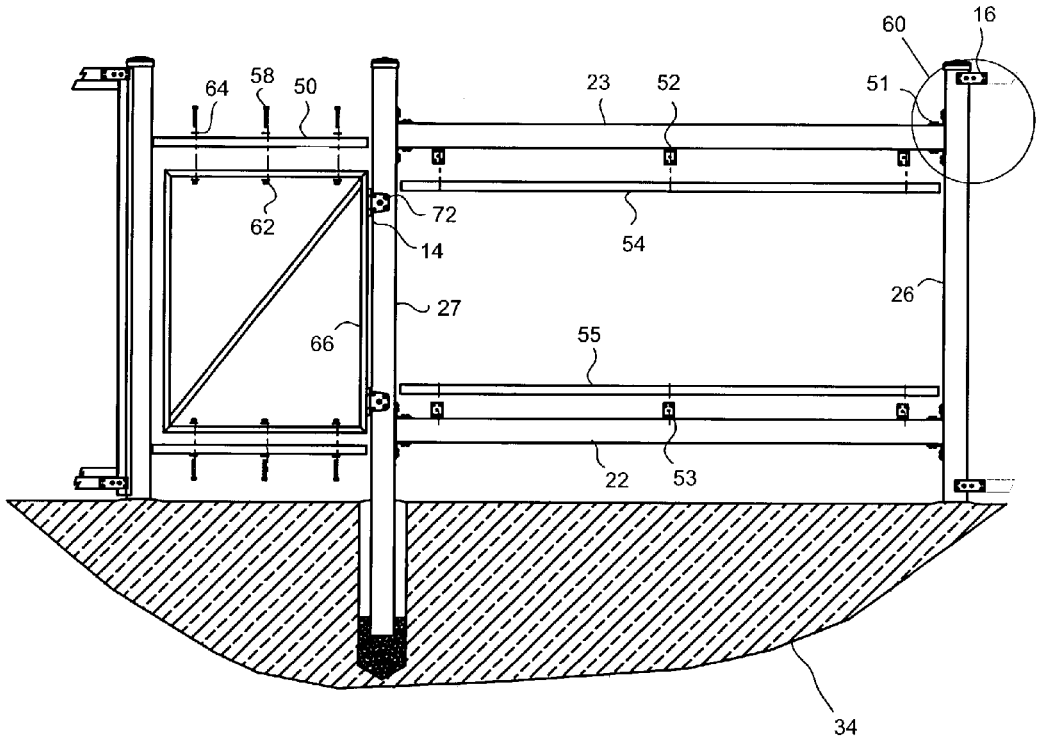
FIG. 6A illustrates the frame of the fence and gate system shown in FIG. 5A.

FIG. 6A illustrates the frame of fence and gate system shown in FIG. 5A. It can be made of wood, metal or a combination thereof. Thus, wood horizontal fence stringers 54, 55 are attached to the fence stringers 22, 23 through a plurality of stringer angle hangers including the stringer hangers 52, 53 and wood screws forming a hybrid metal and wood member framework across the full fence width on the top and the bottom. Wood fence boards 48 are to be attached to the hybrid framework by a plurality of wood screws forming a traditional wood fence. A wood horizontal gate stringer 50 is attached to the top of the gate frame 66 by a plurality of machine screw/bolts 58, flat washers 64, nut and flat washer assemblies 62. The wood horizontal gate stringer 50 length can be sized accordingly to provide a good fit to the gate width opening functioning and a gate width opening adjuster. The style of the gate frame 66 is not limiting to this embodiment that has a cross brace welded diagonally to increase support of the wood gate boards 46.

Figure 6B:
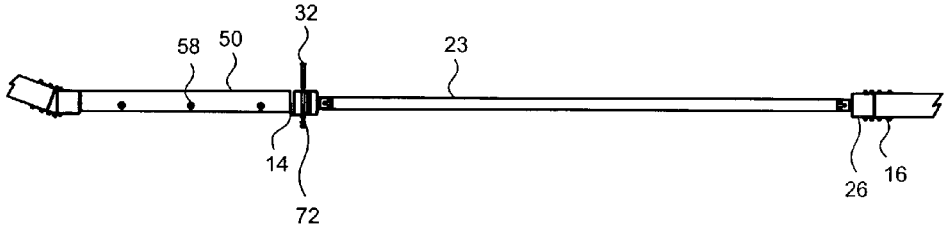
FIG. 6B shows the top view of the frame shown in FIG. 6A.

FIG. 6B is the top view of the system shown in FIG. 6A showing the hybrid metal wood framework in this embodiment. The gate frame 66 is attached to the fence post by a gate hinge 14 and a combination of gate post threaded inserts 32 and bolt and flat washer assembly 72.

Figure 7A:
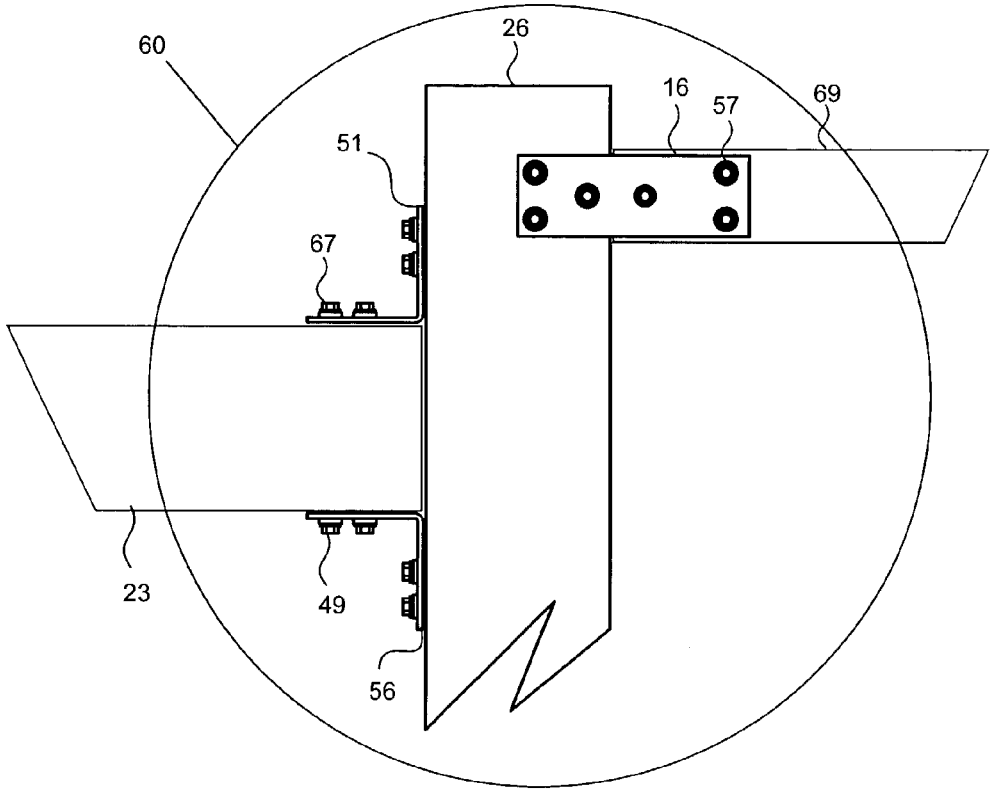
FIG. 7A is an enlarged view of the fence post with stringers shown in FIG. 6A.

FIG. 7A is a detailed view 60 of the fence post 26 shown in FIG. 6A, which is connected differently to the stringers 23, 69. In this embodiment, the fence stringer 23 is rotated 90 degrees. The two stringer angle hangers 51, 56, one on the top end and the other in the bottom end of the fence stringer 23 are mounted to the fence post 26 using a plurality of self drilling and self tapping including the screws 67, 49.

Figure 7B:
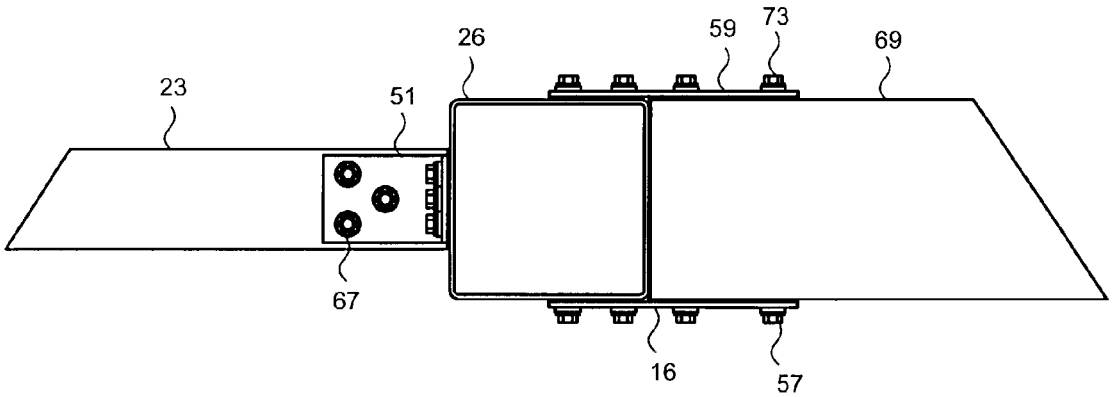
FIG. 7B is a top view of the fence post with stringers shown in FIG. 7A.

FIG. 7B is a top view of FIG. 7A showing the configurations of fence stringers 23, 69 mounted to the fence post 26. The fence stringer 69 is mounted without rotation to the fence post 26 using a pair of stringer hangers 16, 59 one on each side and a plurality of self drilling and self tapping screws identical to the numbered screws 57, 73.

Figure 8A:
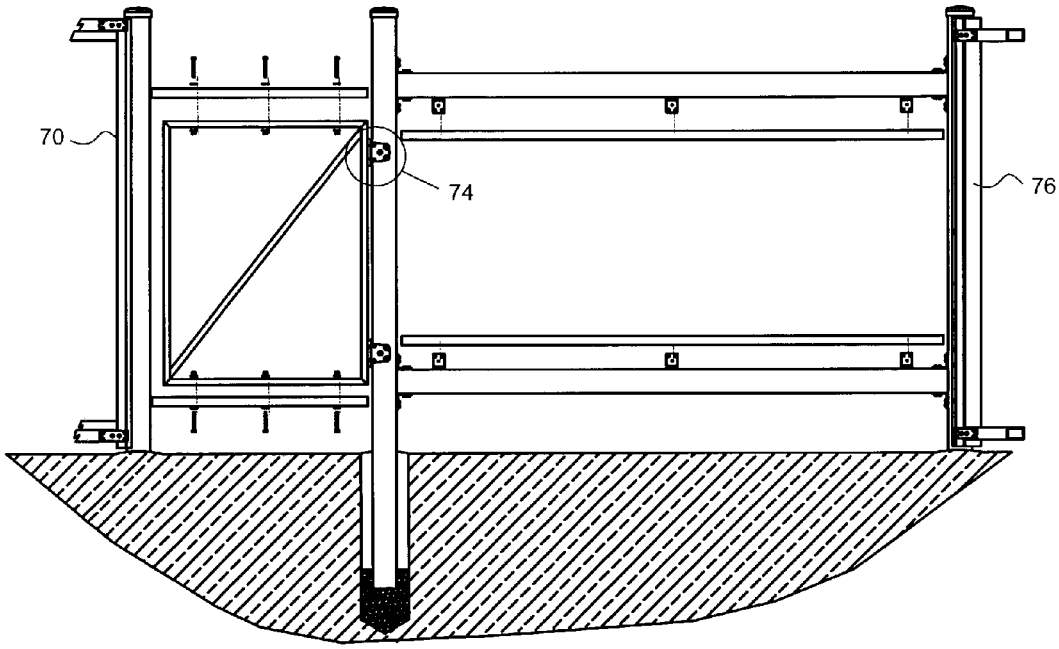
FIG. 8A illustrates post angle adapters as used in the fence and gate system.

FIG. 8A illustrates the use of post angle adapters 70, 76 of the fence and gate system. The gate is connected to another section of the fence using a post angle adapter 70 that has an acute angle of about 20 degrees. The fence is connected to another section of the fence through another post angle adapter 76 that has an acute angle of about 45 degrees. One of ordinary skill would understand that these illustrated angles are not essential to the invention. The details of gate hinge 74 will be discussed later.

Figure 8B:
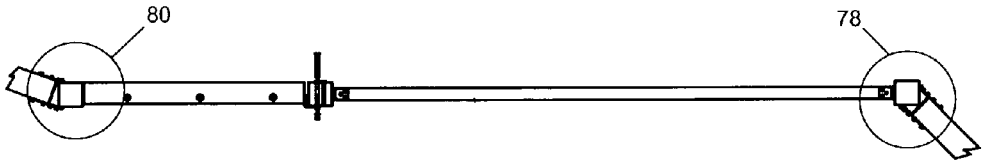
FIG. 8B shows the top view of post angle adapters shown in FIG. 8A.

FIG. 8B shows the top view of FIG. 8A showing the post angle adapters 70, 76. Both the post angle adapters 70 and 76, which in one embodiment are constructed of standard industry thickness preformed and precoated steel sheet metal parts, can be formed in a range of angle increments to connect adjacent sections of the fence structure.

Figure 9A:
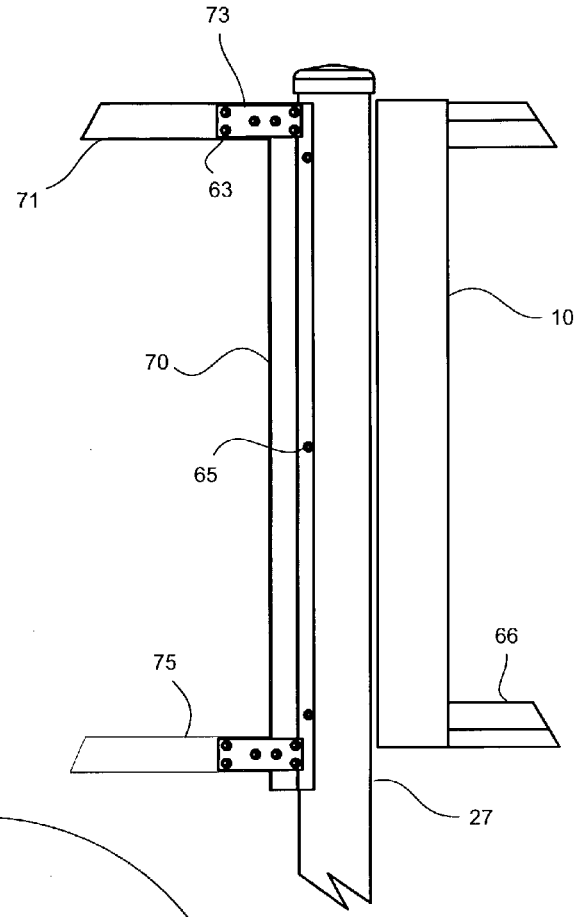
FIG. 9A is an enlarged front view of the post angle adapter to connect a gate frame to a section of the fence frame also shown in FIG. 8A.

FIG. 9A is a detail front view of FIG. 8A showing a gate frame 66 connected to another section of the fence on a fence post 27 using a post angle adapter 70. The post angle adapter 70 is attached firmly to the gate post 27 on both sides using a plurality of self drilling and self tapping screws identical to the numbered screw 65.

Figure 9B:
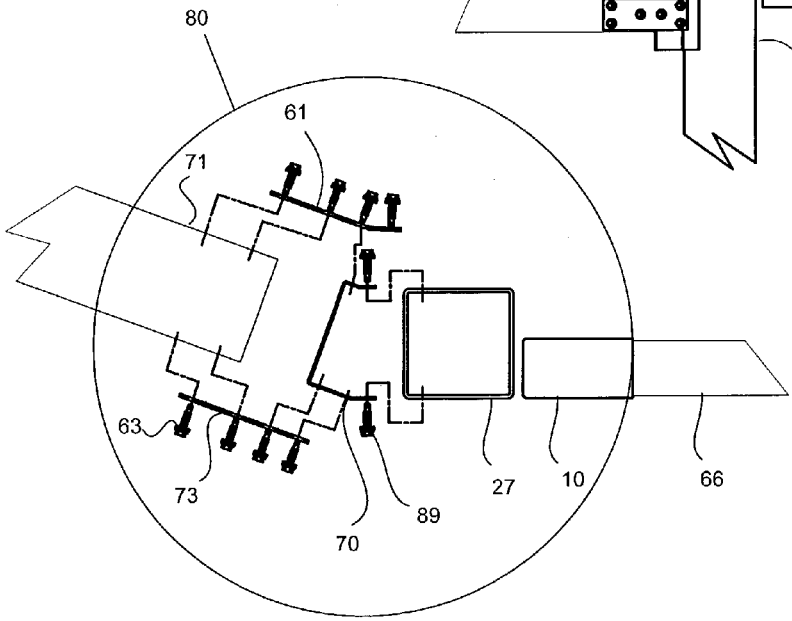
FIG. 9B is an exploded top view of the post angle adapter shown in FIG. 9A.

FIG. 9B is a detail top view of portion 80 shown in FIGS. 8B and 9A. In this illustration, a gate frame 66 is connected to another section of the fence on a fence post 27 using a post angle adapter 70 and a plurality of self drilling and self tapping screws identical to screw 63. The fence stringers 71, 75 are connected to the post angle adapters 70 with a pair of stringer hanger 61, 73 on each side and a plurality of self drilling and self tapping screws identical to screws 63, 89. In this illustration, an angle of 20+/−10 degree can be achieved by flexing the post angle adapter 70 from its mounted position on the fence post 27. It is also shown that the stringer hanger 61 on one side of the fence stringer 71 is being flexed slightly. This minor flexing is tolerated by the steel sheet metal material construction.

Figure 10A:
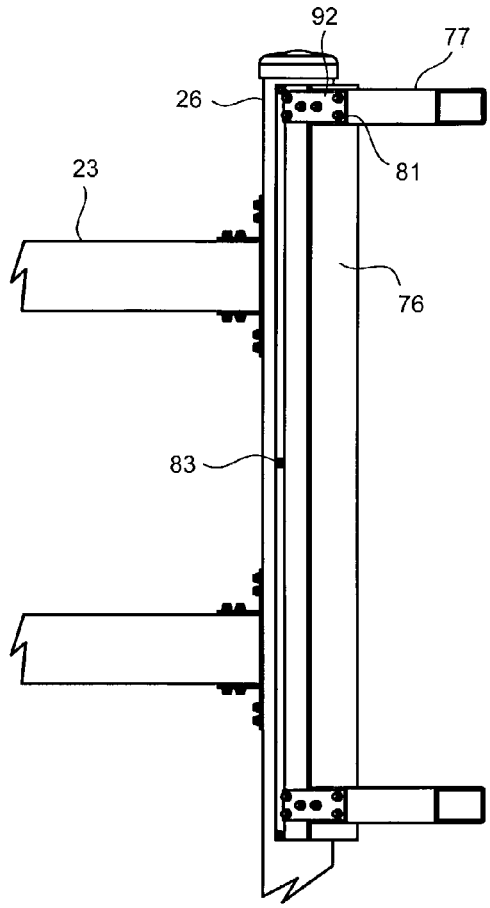
FIG. 10A is a detailed front view showing another post angle adapter for connecting fence sections also shown in FIG. 8A.
Figure 10B:
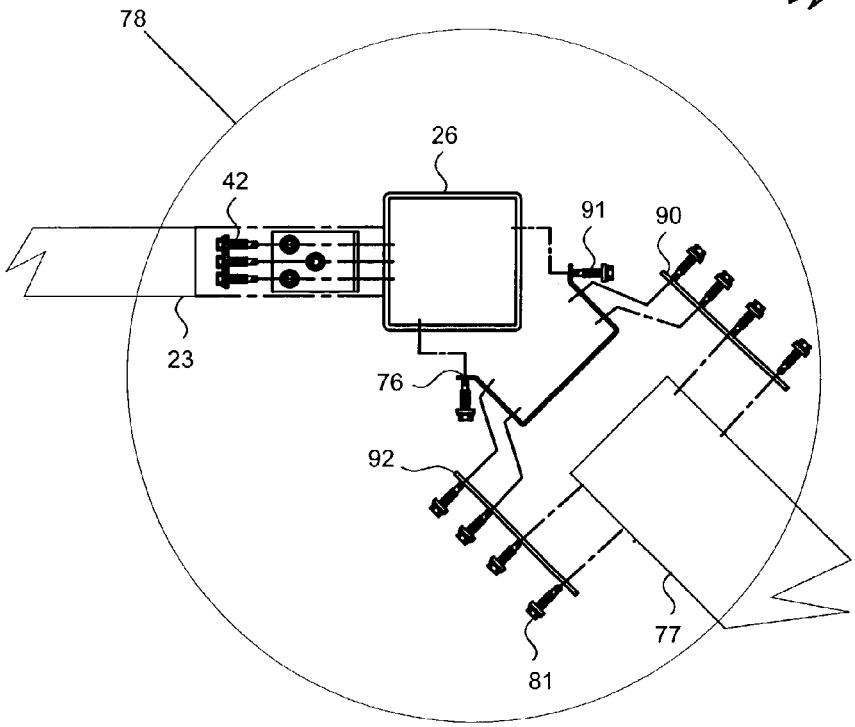
FIG. 10B is a detailed exploded assembly top view of FIG. 10A.

FIG. 10A is a detailed front view showing using another post angle adapter 76 to connect two fence sections together in FIG. 8A. The post angle adapter 76 is attached firmly to the gate post 26 on both sides using a plurality of self drilling and self tapping screws 81, 83. FIG. 10B is a detailed top view of portion 78 shown in FIGS. 8B and 10A. In this illustration, two fence sections are connected on a fence post 26 using a 45+/−10 degree post angle adapter 76 and a plurality of self drilling and self tapping identical to the screws 81, 91. It is also shown that there is no flexing on the stringer hanger 90, 92 on either side of the fence stringer 77 using this post angle adapter 76.

Figure 11A:
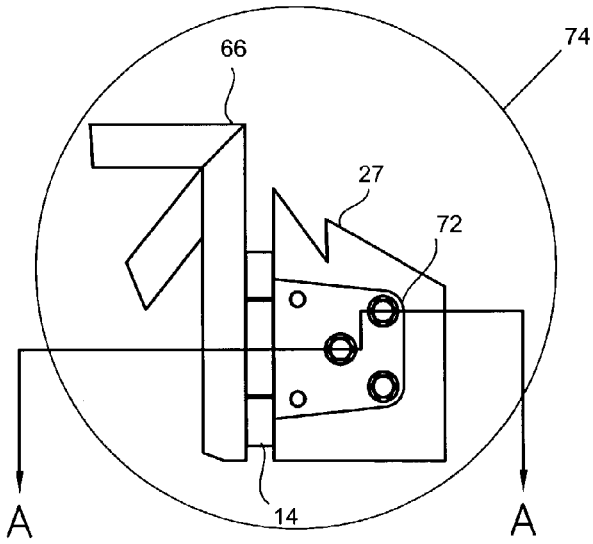
FIG. 11A is a detailed front view showing part of the gate frame attached to the fence post through a gate hinge also shown in FIG. 8A.

FIG. 11A is a detailed front view of portion 74 shown in FIG. 8B. This shows the portion of the gate frame 66 attached to the fence post 27 through a gate hinge 14 in FIG. 8A.

Figure 11B:
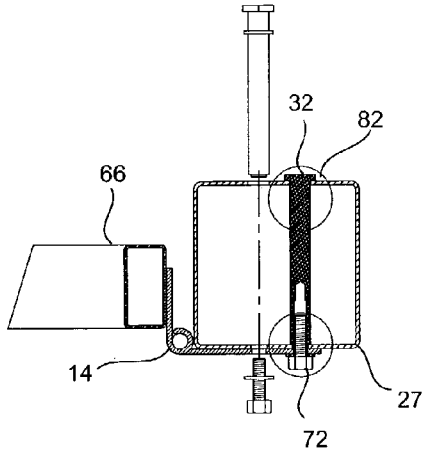
FIG. 11B is a top section view of FIG. 11A showing the use of gate post threaded insert assemblies holding the gate hinge in place.

FIG. 11B is a section view of FIG. 11A showing the use of a gate post threaded insert 32 with a gasket 82 swaged tightly with the matching bolt and flat washer assemblies 72 across both sides of the fence post 27 holding the gate hinge 14 in place. Also shown is gate frame 66 connected to the gate hinge 14.

Figure 11C:
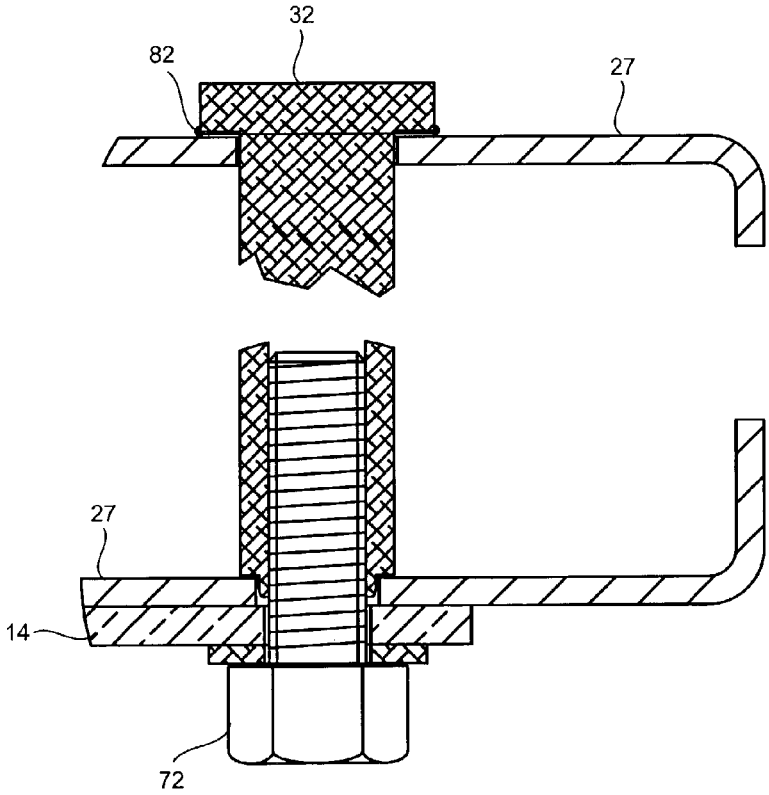
FIG. 11C is a detailed view of FIG. 11B showing the design of the gate post threaded insert.

FIG. 11C is a detail view of FIG. 11B showing the design of the gate post threaded insert 32. The gate post threaded insert 32 in an embodiment is machined from a solid hard metal or alloy such as steel. One end forms the head with a pattern that can be held in place or driven with a tool. The head pattern is not limiting in its current hexagonal design. A nut driver or other tools can be fitted over the head to hold the gate post threaded insert 32 in position or to rotate for tightening. The body of the gate post threaded insert 32 is smooth. The tail end is blind drilled and tapped to a specified depth. The thread size of the gate post threaded insert 32 will be industry standard. It is threaded to mate with common and available bolt hardware. It should be pointed out that the outer body of this preferred embodiment structure can be machined to a lower diameter forming a minor diameter at the tail end for hole clearance to the steel fence post 27 when under tight compression.

In the preferred embodiment, the gate post threaded insert 32 is used together with a combination of the gasket 82 for a moisture seal and a bolt and flat washer assembly 72 to achieve tight compression on both surfaces of a hollow steel fence post 27. Along with the benefits of other anticipated applications, one of the purposes of this gate post threaded insert 32 is to distribute suspended load stress across the entire hardware assembly. This improves the strength of the hardware holding the gate hinge 14. It is understood that the post threaded insert 32 is suitable for a variety of application beside its illustrated use in the fence and gate systems.

Figure 12B:
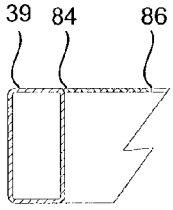
FIG. 12B is a section view of one end of a gate frame in FIG. 12A showing a welded on surround metal back flange.
Figure 12A:
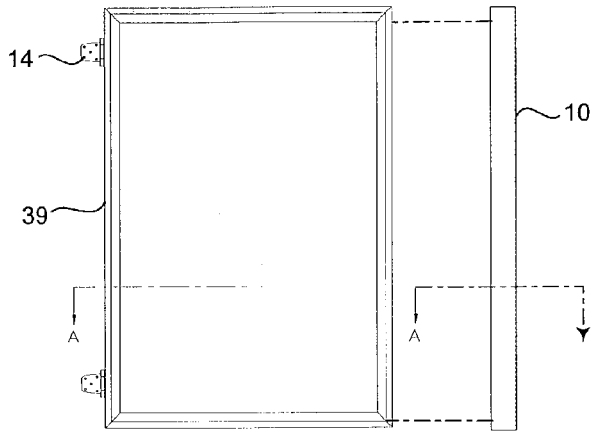
FIG. 12A is a front view of a gate frame and a gate width opening adjuster assembly in another embodiment, wherein the gate hinges are on the left side.

FIG. 12A is a front view of a gate frame 39 and a gate width opening adjuster 10 in another embodiment, wherein the gate hinges, e.g., gate hinge 14 are on the left side. FIG. 12B is a section of one end of the gate frame shown in FIG. 12A showing a weld 84 between the gate frame 39 to the surround metal back flange 86.

Figure 12C:
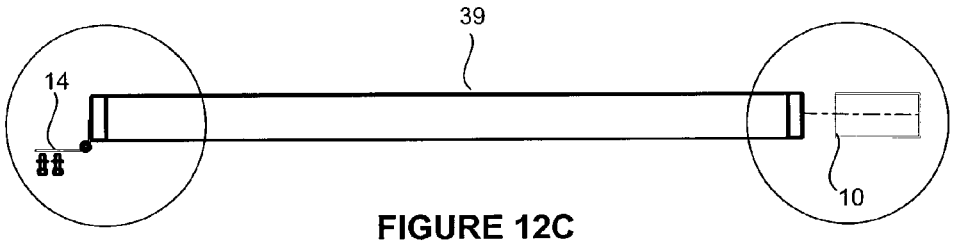
FIG. 12C is a full section view of FIG. 12A.

FIG. 12C is a full section view of FIG. 12A. The gate width opening adjuster 10 in one embodiment is constructed of Industry standard thickness galvanized steel metal extrusion or formed from sheet metal. The top end of the gate width opening adjuster 10 is welded close to keep rain out while the other end is open for venting. The gate hinge 14 is welded to the gate frame 39.

Figure 12D:
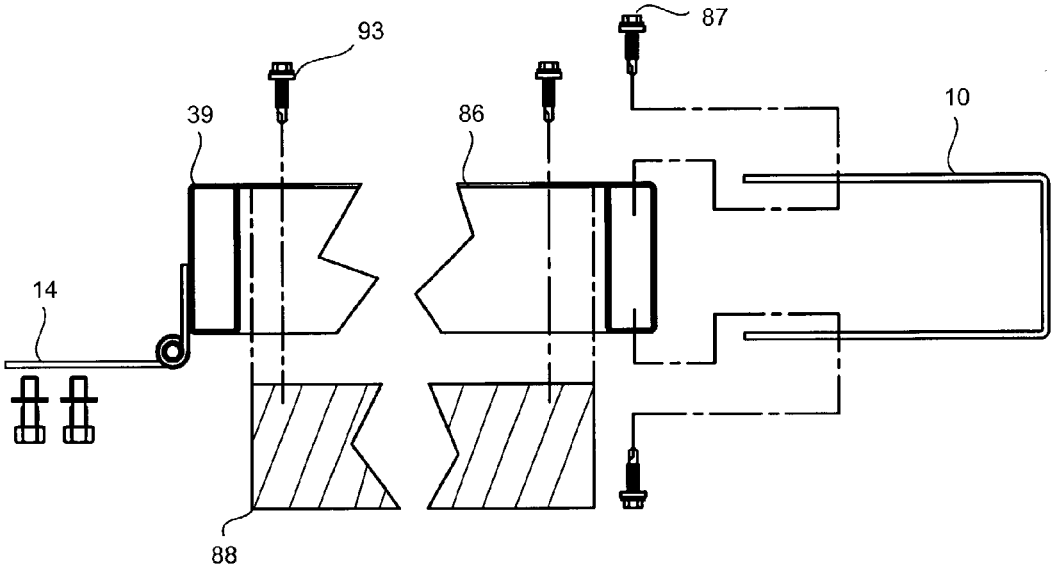
FIG. 12D is an exploded assembly view of FIG. 12C showing the gate hinge and the attachment of the gate width opening adjuster to the opposite end.

FIG. 12D is a detailed exploded assembly view of FIG. 12C showing the gate hinge plate 14 welded to the gate frame 39 to one end and the attachment of the gate width opening adjuster 10 to the opposite end. The width adjustment is achieved by attaching the gate width opening adjuster 10 at the opposite end of the gate frame 39 by sliding back and forth to determine the position using a plurality of self drilling and self tapping screws identical to screw 87. The gate panel 88 is screwed down to the surround metal back flange 86 using a plurality of self drilling and self tapping screws identical to screw 93. This gate width opening adjustment method eliminates the use of a gate shim or lip.

Figure 13:
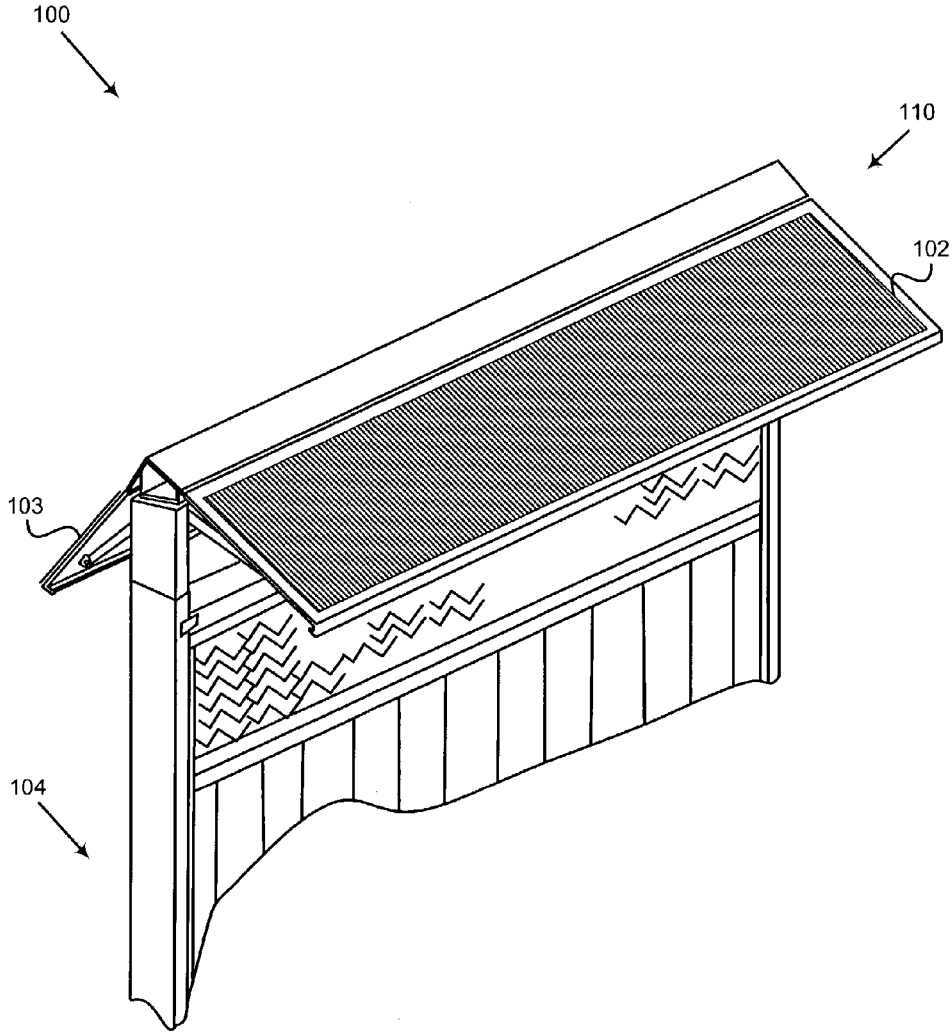
FIG. 13 is a perspective view of a section of the configurable fence system with solar panels and support structure added onto the fence.

FIG. 13 is a perspective view of an embodiment of the configurable fence system 100 showing solar panels 102, 103 installed over the support structure 110 that is mounted on top of a fence section 104. The support structure 110 spans the length of the fence section 104 to support the solar panels 102, 103, where the solar panels 102, 103 convert solar energy into either electrical power or thermal energy for a variety of applications. This has several advantages since solar power generation research has become a mature technology with much improved power conversion efficiency. With sufficient solar panels it is possible to supply much if not all the power requirements to the household and even with spare power to sell back to the power grid during certain hours of the day. With solar power installation rebate incentives from the power company along with tax credit from some state and the federal government, the rate of return on the total energy cost savings after rebates and tax credit is attractive. The fence system, solar panels, and installation cost may be recaptured within several years.

Figure 14:
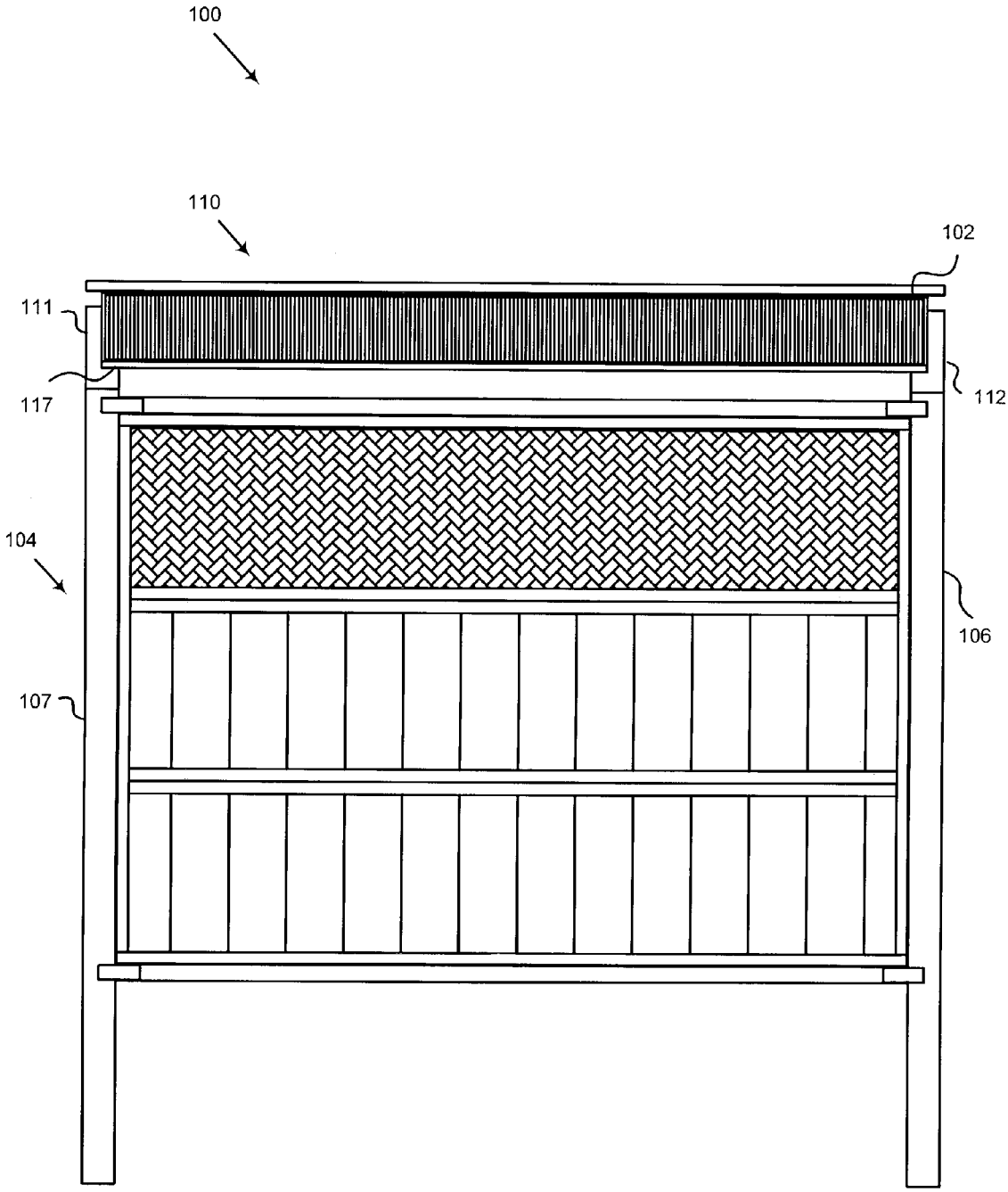
FIG. 14 is a front view of a section of the configurable fence system with solar panels and the support structure.

FIG. 14 shows the front view of a section of the configurable fence system 100 with a solar panel 102 installed on the mounting surface 117 of the support structure 110 that is mounted on top of the fence posts 106, 107 of a fence section 104 through the post extensions 112,111.

Figure 15A:
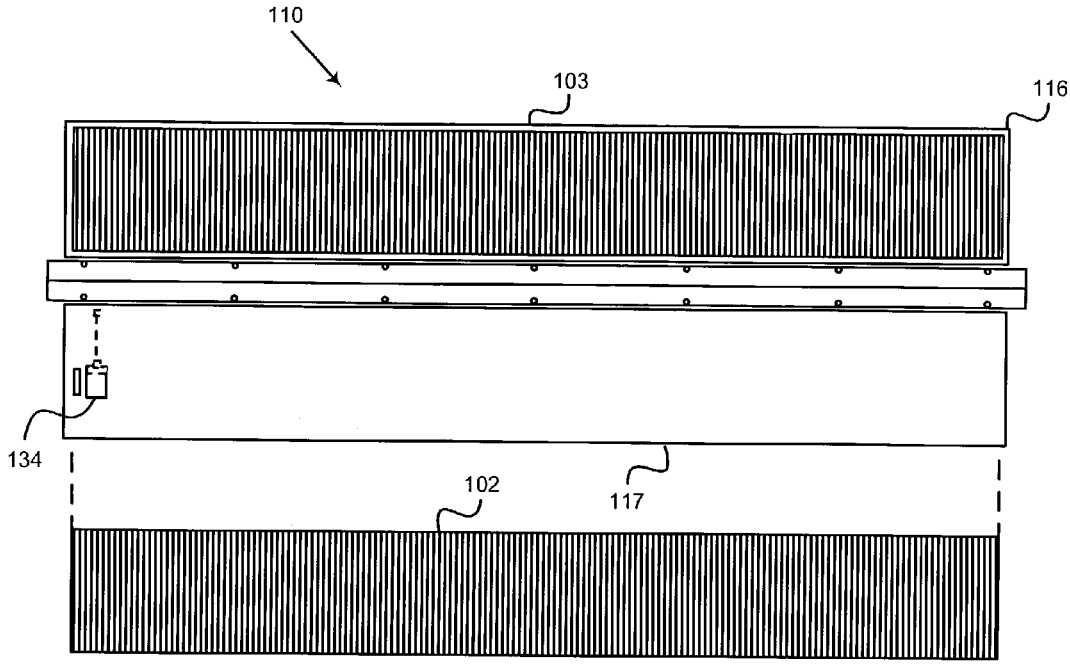
FIG. 15A is a top view of the solar panels and the support structure with one panel removed to show an underlying electrical wiring box.

FIG. 15A is a top view of the support structure 110 with one solar panel 102 removed to expose the mounting surface 117. The mounting surface 117 shows an opening to an electrical wiring box 134 where electrical wiring from solar panel 102 passes through. The solar panels 102, 103 in this embodiment are known as solar panels or mats such as a Uni-Solar™ photovoltaic laminate of standard length with adhesive backing that adheres to the mounting surfaces 116, 117. A suitable material for the mounting surfaces 117, 116 is an electro-galvanized sheet metal that can be obtained from Galvalune™.

Figure 15B:
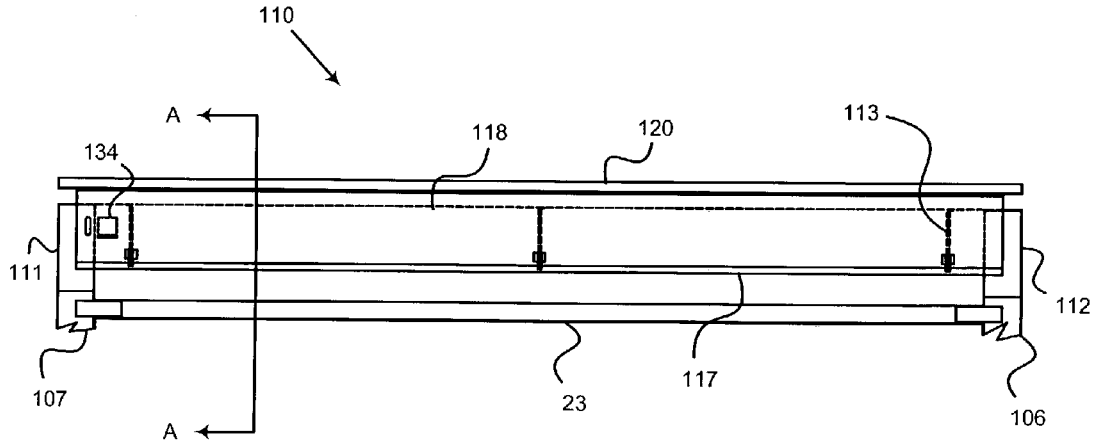
FIG. 15B is a front view of the support structure without any solar panels.
Figure 17:
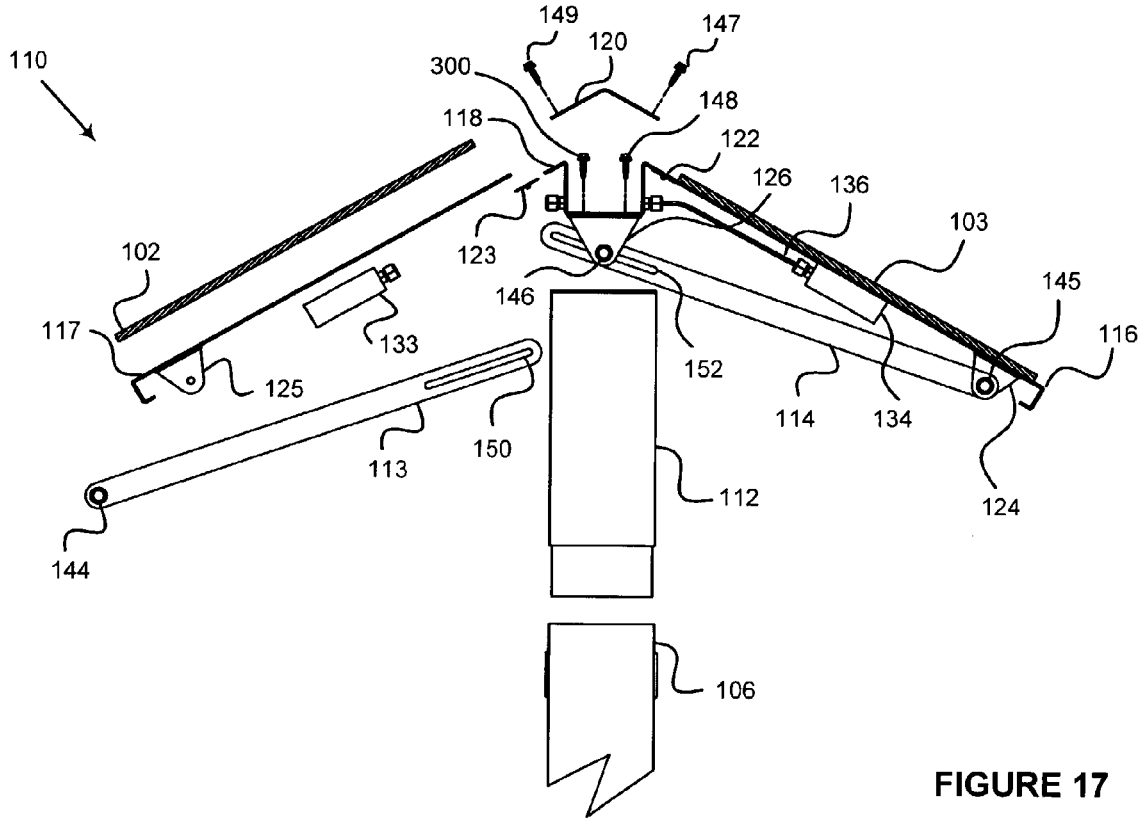
FIG. 17 is an exploded end view of the support structure.

FIG. 15B is a front view of the support structure 110 with solar panel 102 removed. The entire support structure 110 slides over the fence posts 106, 107, on each side of stringer 23, through the post extensions 112, 111 on both ends. FIG. 17 will describe additional details of the electrical wiring box 134, angle adjusting arm 113, center support and wiring tray 118 and the wire raceway cover 120.

Figure 16A:
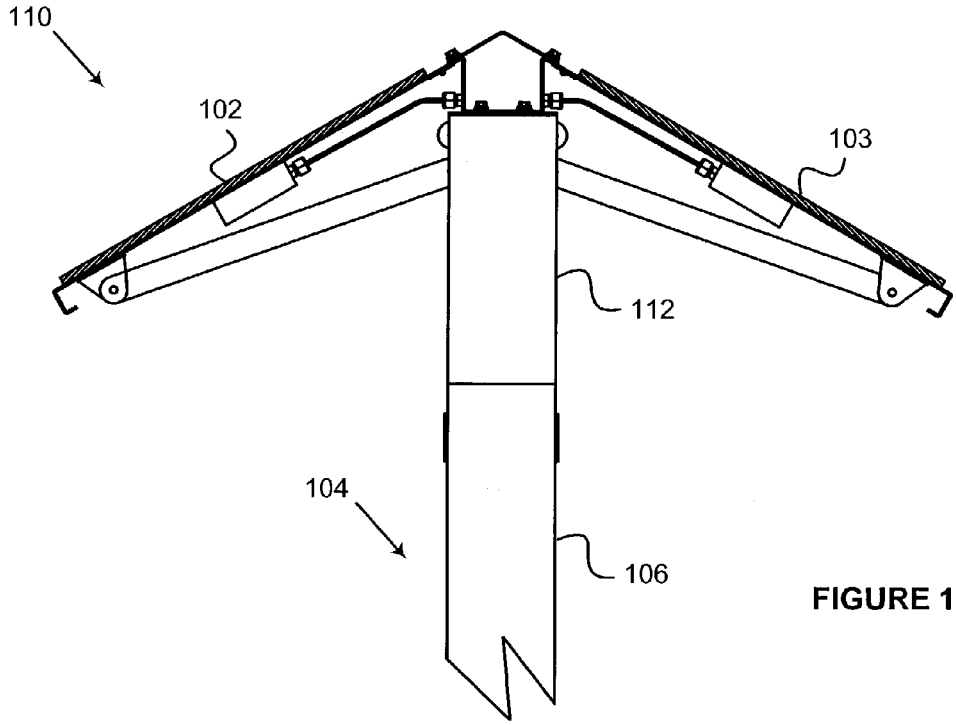
FIG. 16A is an end view of the support structure and the solar panels.

FIG. 16A is an end view of the support structure and solar panels. In an embodiment, the support structure 110 is preferably made of powder coated galvanized sheet metal steel mounted on top of a fence section 104 (FIG. 14). To install the support structure 110 on the fence section 104, the post cap on the fence is removed and the post extension 112 is inserted into the fence post 106. Likewise, the post extension 111 (FIG. 14) is inserted into the fence post 107 (FIG. 14) In an alternative embodiment, the fence posts 106, 107 can extend vertically upward to serve as post extensions 112, 111 so that the support structure 110 is an integral extension of the fence section 104. The fewer parts in this embodiment permit faster assembly when the owner knows solar panels 102, 103 will be used with the fence.

Figure 16B:
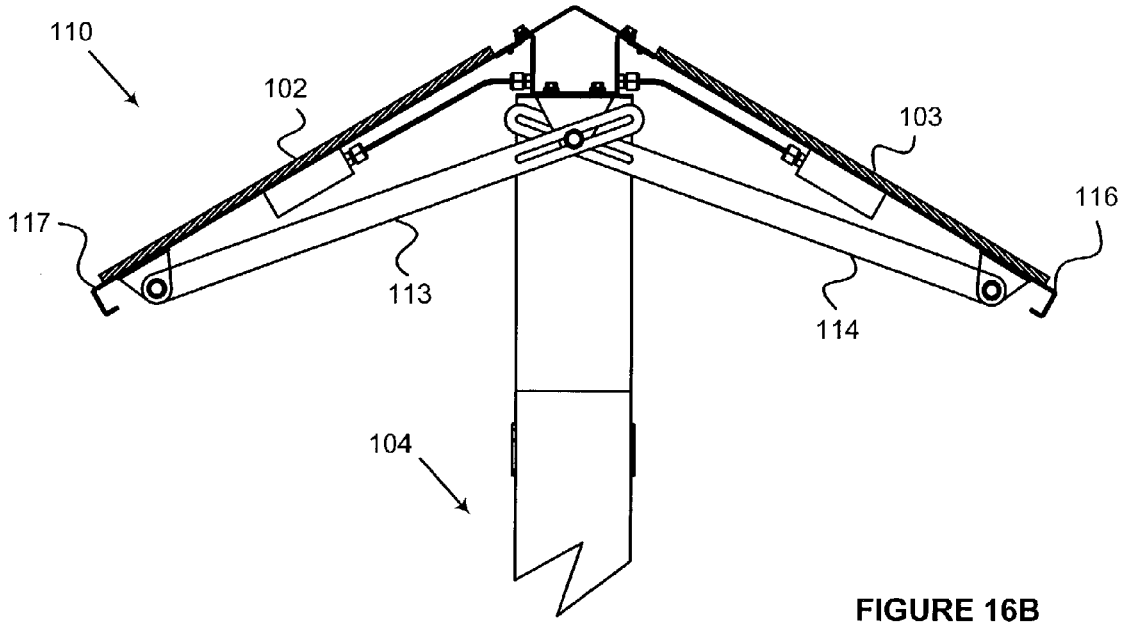
FIG. 16B is a sectional view showing the details of the support structure.

FIG. 16B is a sectional view of the support structure 110 taken on line A—A of FIG. 15B. In this embodiment, the support structure 110 includes arm 114, 113 to independently tilted mounting surfaces 116, 117 whose tilt angle can be adjusted manually or by a conventional closed loop control system using solar detection by providing a motor (not shown) to actuate the arms 113, 114 so electric power generation is maximized.

FIG. 17 is an exploded end view of the support structure 110. In this embodiment, the solar panel 103 rests over the mounting surface 116 with an opening where an electrical wiring box 134 with wiring conduit 136 assembly beneath the mounting surface 116 brings the insulated electrical wiring from the solar panel 103 to the center support and wiring tray 118. The rectangular mounting panels 116, 117 with electrical wiring boxes 134, 133 underneath are connected to the center support and wiring tray 118 that can be made from a single piece gutter like corrugated steel structure through a pair of support hinges 122, 123 to allow certain degree of angular movement. The center support and wiring tray 118 is a conduit for the insulated wire conducting the electrical current to the adjacent fence sections or to the power grid.

A wire raceway cover 120 can be also made of a single piece of sheet metal which is secured as a cover with driller screws 147, 149 to the center support and wiring tray 118 to protect the insulated electrical wiring from rain and sunlight weathering. An arm support plate 126 is welded beneath the center support and wiring tray 118 to function as a pivot point to provide angular adjustment by allowing the angle adjusting arms 113, 114 to slide along the slots 150, 152. The opposite ends of the angle adjusting arms 113, 114 are connected to the angle brackets 124, 125 that are welded onto the mounting surfaces 116, 117. The bolt and nut assemblies 144, 145, 146 are to hold the angle adjusting arms 113, 114 in place. The entire support structure 110 is secured in place at both ends to the post extension 112 and post extension 111 (FIG. 14) with a plurality of driller screws 148, 300, and inserted over the fence post 106 and fence post 107 (FIG. 14).

Figure 18:
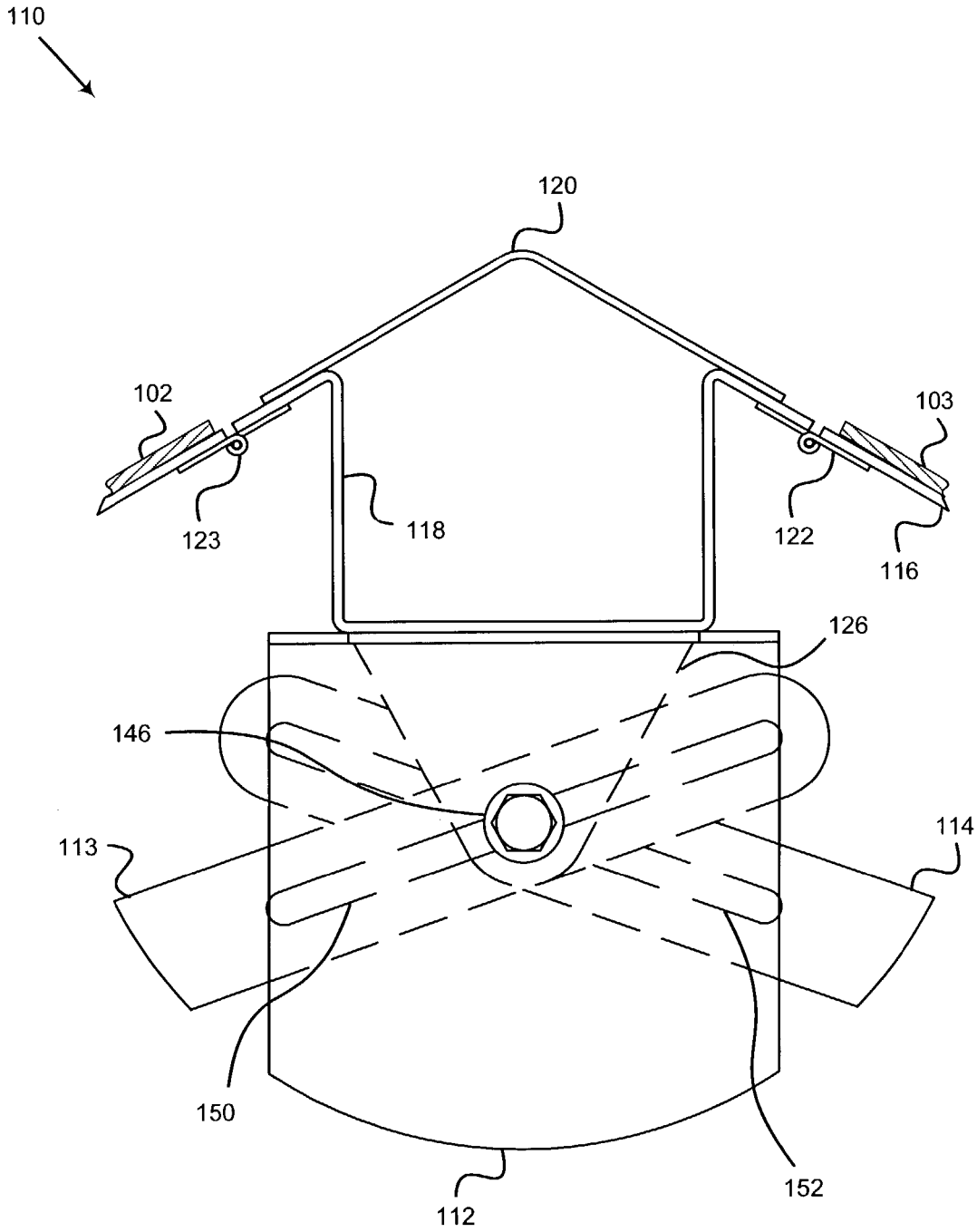
FIG. 18 is an enlarged detailed view showing the angle adjusting arms.

FIG. 18 is an enlarged detailed view showing the angle adjusting arms 113, 114 where angular adjustment is made by sliding the arm along the slots 150, 152 then locking the position in place by tightening the bolt and nut assembly 146. The entire supporting structure 110 may be constructed with any high strength material with acceptable life expectancy.

Figure 19:
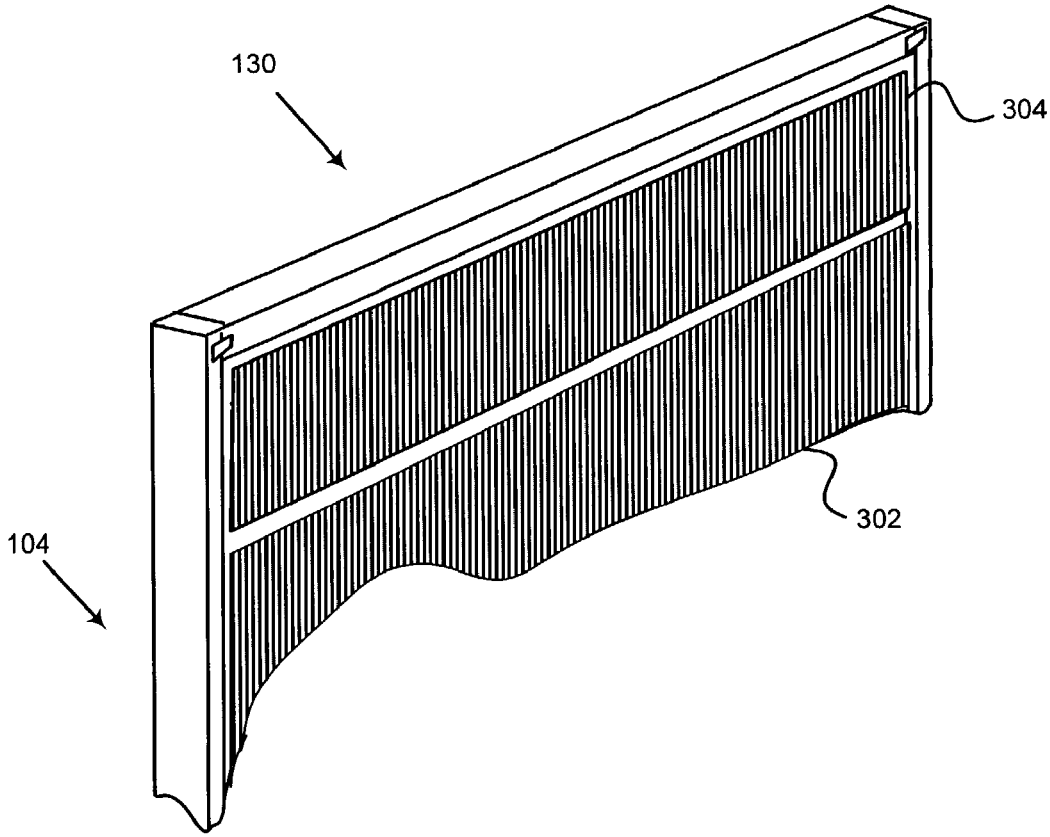
FIG. 19 is a perspective view of another embodiment of the configurable fence system showing two solar panels installed over the existing vertical panel surface area of the fence section.

FIG. 19 is a perspective of an embodiment of configurable fence system 130 where one or more solar panels 302, 304 can be installed in place as described above or laminated over the existing vertical fence panels of the fence section 104.

What is claimed is:

1. A configurable fence system having a solar panel, comprising:

a pair of fence posts, connected by two parallel horizontal fence stringers forming a rectangular fence framework;

a pair of longitudinal cross section L-shaped retainer angles, with a parallel separation to be defined by the thickness of a panel to be inserted, mounted on each of the inner surfaces of the rectangular fence framework in an orientation of either face-to-face or back-to-back to form an enclosed slotted rectangular fence framework;

a support structure extending from or secured to the rectangular fence framework including a mounting surface for a solar panel;

a solar panel secured to the mounting surface; and a closed loop control system including a motor coupled to the mounting surface to tilt the mounting surface with respect to the fence to maximize the amount of sunlight captured.

2. A solar system adapted to mount on a fence, comprising:

a support structure mounted along the top length of the fence;

a first mounting surface extending from or secured to the supporting structure;

a first solar panel on the first mounting surface;

a second mounting surface extending from or secured to the supporting structure;

a second solar panel on the second mounting surface; and means for tilting the first mounting surface and the second mounting surface with respect to the fence for optimal exposure to the sunlight, wherein the means for tilting is coupled to a motor and a solar detection and feedback control system for motorized adjustment.

3. A solar system adapted to mount on a fence, comprising:

a plurality of extensions mounted along the top length of the fence;

a first mounting surface extending from or secured to the plurality of extensions;

a first solar panel on the first mounting surface;

a second mounting surface extending from or secured to the plurality of extensions;

a pair of arms extending from each of the plurality of extensions to the first and second mounting surfaces; and a second solar panel on the second mounting surface, wherein the pair of arms are adjustable for tilting the first mounting surface and the second mounting surface with respect to the fence for optimal exposure to the sunlight and wherein the pair of arms are coupled to a motor and a solar detection and feedback control system for motorized adjustment.

* * * * *